United States Patent [19]

Edwards

[11] 4,077,789

[45] Mar. 7, 1978

[54] VAPOR CONDENSING AND RECOVERY ASSEMBLY INCLUDING A DECANTER FOR VAPOR RECOVERY SYSTEM

[75] Inventor: Ray C. Edwards, Kinnelon, N.J.

[73] Assignee: Edwards Engineering Corporation, Pompton Plains, N.J.

[21] Appl. No.: 673,043

[22] Filed: Apr. 2, 1976

Related U.S. Application Data

[62] Division of Ser. No. 598,004, Jul. 22, 1975, Pat. No. 4,027,495.

[51] Int. Cl.[2] ..... F17C 7/02

[52] U.S. Cl. ..... 62/54; 62/282; 62/512

[58] Field of Search ..... 62/54; 5/80, 82, 151, 5/282, 512

[56] References Cited

U.S. PATENT DOCUMENTS

| | | | |
|---|---|---|---|
| 2,440.738 | 5/1948 | Cooper | 62/54 |
| 3,339,376 | 9/1967 | Taggart | 62/282 |
| 3,791,422 | 2/1974 | Johnson et al. | 62/54 |

*Primary Examiner*—Ronald C. Capossela
*Attorney, Agent, or Firm*—Daniel H. Bobis

[57] ABSTRACT

A decanter for a system and apparatus for condensing and recovering vapors of low volatile liquids such as hydrocarbons has an inlet for the condensed vapors of the low volatile liquid, and an outlet for passing condensate from said decanter, a separating chamber in the decanter communicates with the inlet to receive condensate mixed with water and a second chamber communicates with the outlet, a transfer device permits separated condensate to pass to the second chamber and a heater is provided in the first chamber to maintain the water mixture above the freezing point thereof and preferably in a range from 40° F to 70° F.

7 Claims, 25 Drawing Figures

VAPOR CONDENSING AND RECOVERY ASSEMBLY INCLUDING A DECANTER FOR VAPOR RECOVERY SYSTEM

This is a division, of application Ser. No. 598,004 filed July 22, 1975, now U.S. Pat. No. 4,027,495.

BACKGROUND OF THE INVENTION

This invention relates generally to methods and apparatus for the recovery of vapors of low volatile fluids such as liquid hydrocarbons or liquid chemicals whose vapors may pollute and contaminate the air in a confined space or the atmosphere generally and more particularly to a system and apparatus for the recovery of such vapors by condensation of the vapors at atmospheric pressure through specially designed non-contacting heat exchange apparatus and the cooling systems therefore.

Since the passage of the Clean Air Act, the Congress of the United States has required that all persons or organizations handling hydrocarbons or chemicals whose vapors may pollute the air must install means to recover and prevent the contamination of the air by such vapors.

For example such vapors are generated and displaced into the atmosphere when all types of tanks are filled with liquid hydrocarbons or liquid chemicals. Such tanks may be large storage tanks, railroad car tanks, truck tanks, underground storage tanks for gasoline stations and fuel tanks on trucks, buses and automobiles. When these various types of tanks are filled with liquid hydrocarbons or liquid chemicals vapors escape into the atmosphere and as is well known such vapors become a source of smog which under certain ambient conditions produce dangerous fog conditions and so pollute the atmosphere that they produce dangerous environmental health hazards for human beings.

There are at least four methods with corresponding apparatus for recovering or eliminating these detrimental vapors. These may generally be summarized as burning, adsorption, absorption and condensation. Each of these methods and the associated apparatus have advantages and disadvantages as is well known and understood by those skilled in the art.

The present invention treats with the condensation techniques wherein the generated vapors are condensed at atmospheric pressure by non-contacting heat exchange relation i.e. by condensation of the vapors at atmospheric pressures on cold surfaces.

This condensation method and apparatus in accordance with the present invention has a low operating cost and does not waste valuable and expensive hydrocarbon fuels such as methane, ethane and propane. Methane, ethane and propane are used in the above described method of burning the vapors and therefor wasted.

The condensation method also has a moderate capital cost and low maintanence costs which distinguishes it from the adsorption methods and apparatus where there is a high capital cost for the apparatus and high operating costs because of replacement of the activated charcoal materials used to adsorb the vapors being recovered. It does not have the compression requirements, high capital cost, high operating costs, high maintainence costs and small net recovery of condensed vapor as exist with respect to the absorption methods and apparatus.

The condensation method and apparatus of the present invention has a sufficiently high rate of recovery of hydrocarbons or chemicals that the value thereof may be sufficient to pay for the capital cost of the equipment, the operating and the maintanence cost thereof.

Various types of absorption systems are shown in U.S. Pat. Nos. 2,849,150, 3,771,317, 3,815,327 and 3,830,074.

Vapor recovery devices which utilize condensing techniques of the non-contacting type are shown in U.S. Pat. Nos. 2,379,215 and 3,648,436.

In U.S. Pat. No. 3,714,790 the vapors to be recovered are compressed and then past in direct contact with a cooling liquid of the same low volatile substance from which the vapors emanated, to condence the vapors and to recover the same.

The present invention is directed to the recovery of hydrocarbon vapors and more particularly those hydrocarbon vapors being emitted during the handling of fuels such as gasoline, diesel fuel, jet engine fuels etc., which predominately emit vapors such as butane, isobutane, pentane, iso-pentane and heavier hydrocarbons in access of six carbon linkages.

It is known that the percentage of hydrocarbon vapors in the mixture of vapors vented from a given tank or like storage facility as it is filled ranges up to 65% of the vented mixture depending upon the ambient temperature, type of fuel, reed vapor pressure of the fuel, type of tank loading (splash or bottom loading) and the degree of agitation of the tank. The remaining portion of the vented mixture will include, water vapor and non-condensible gases.

Water vapor presents a problem in non-contacting condensing apparatus because the condensing surfaces therein disposed for heat exchange relation with the predominant and recoverable vapors above enumerated must be maintained, at atmospheric pressure, in a temperature range of −70° F to −110° F, in order to condense and efficiently recover these fractions of the vented mixture escaping or leaving a given tank.

Because the water vapor freezes out of such mixtures at 32° F, it constitutes a difficult component of the vented mixture in that at these temperature ranges for efficient recovery, frost or icing of the non-contacting heat exchange surfacesin the flow passages of the condensing apparatus; and more particularly on the finned surfaces which are generally provided on such heat exchange surfaces to increase the area of heat exchange; will act either to stop the flow of the vented mixture through the flow passages in the condensing apparatus or will produce a back pressure in the flow passages of the condensing apparatus which will cause the relief valves on the tanks being filled or emptied to open and thus cause recoverable vapors to be expelled to the atmosphere.

The present invention overcomes this problem by providing an improved vapor condenser wherein the non-contacting heat exchange surfaces the flow passages therethrough are designed so that frost or icing buildup thereon is prevented from blocking off the flow of the vented mixture through the heat exchange members in the flow passages of the vapor condenser, and the flow passages have a U-shaped design to act as a thermal trap for preventing convection currents of ambient air from entering the vapor condenser at off cycle or low load conditions as the moisture therein would quickly plug the heat exchange surfaces or fins with frost and ice.

Further the system includes means to defrost the vapor condenser so as to control and prevent frost or icing of the heat exchange surfaces during the normal course of operation of the system.

SUMMARY OF THE INVENTION

Thus, the present invention covers a system for condensing and recovering vapors of low volatile liquids such as hydrocarbons including, in combination, a cascade compression refrigeration system for providing and maintaining a cooling fluid such as brine at a predetermined relatively low temperature, a storage and circulating system for the brine coolant; a vapor condensing assembly including, a vapor condenser having; an inlet for the vapor mixture with said low volatile vapors to be condensed, and an outlet for venting non-condensed vapors therefrom; a flow passage means between said inlet and outlet, condensing coil means in said flow passage, and means connected between said storage and circulating system and said condensing coil for delivering brine coolant to said condensing coil means and for returning the same to the storage and circulating system to maintain the condensing coil at constant temperature, and a decanting means operatively associated with the vapor condensing assembly to separate and recover the vapors condensed therein.

Additionally, the system for recovering vapors of low volatile liquids above described including, a defrosting system, means connecting said defrosting system to said vapor condensing assembly and to said decanting means, and means for intermittently defrosting the condensor coil means in said vapor condensing assembly, and means to circulate heated defrosting fluid from the defrosting system to the decanting means for heating the condensed vapors approximately to ambient atmosphere temperature.

Additionally, a vapor condenser for use in a system for recovering vapors of low volatile liquids including, an inlet for the vapor mixture having low volatile vapors to be condensed, and an outlet for venting non-condensed vapors therefrom, U-shaped flow passage means in the vapor condenser having one end connected to said inlet and the other end connected to said outlet, and condensing coil means in said U-shaped flow passage, said condensing coil means having, an entrance section in the portion of the flow passage connected to the inlet, and an exit section in the flow passage in communication with the outlet; fins on said condensing coil means, the said fins on the entrance section in the condensing coil means being relatively widely spaced in the portion of the entrance section adjacent the inlet and the said fins on the entrance section remote from the inlet less widely spaced and in alignment with the fins adjacent to the inlet, a collecting section for condensed vapors formed in said vapor condenser below the U-shaped flow passage means, and a discharge conduit for collected condensate in communication with the collecting section in the vapor condenser.

The above and other objects and advantages of the system are believed made clear by the following detailed description thereof taken in conjunction with the accompanying drawings wherein, FIG. 1 is a schematic view of one form of Vapor Recovery System in accordance with the invention.

Figure 1:
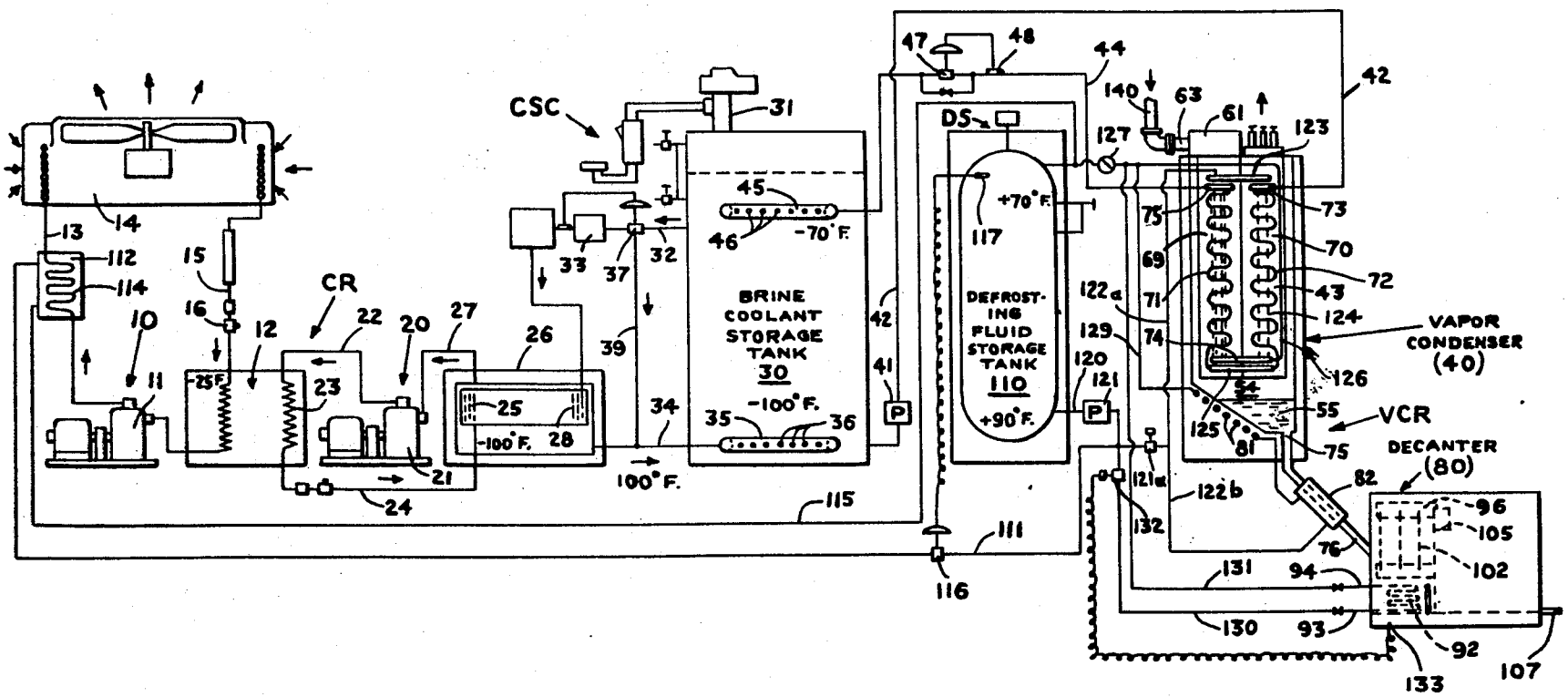
Figure 2:
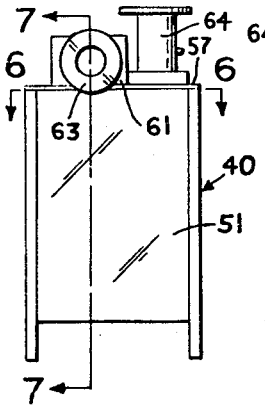
FIG. 2 is a front elevational view of the form of Vapor Condenser shown in the Vapor Recovery System of FIG. 1.
Figure 3:
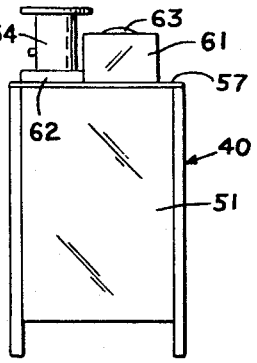
FIG. 3 is a back view of the Vapor Condenser shown in FIG. 2.
Figure 4:
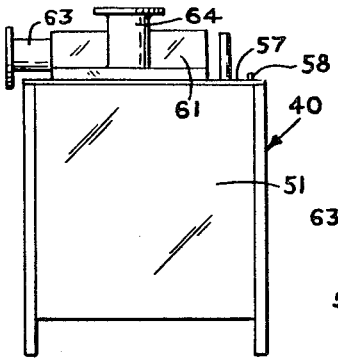
FIG. 4 is a side view of the Vapor Condenser shown in FIG. 2.
Figure 5:
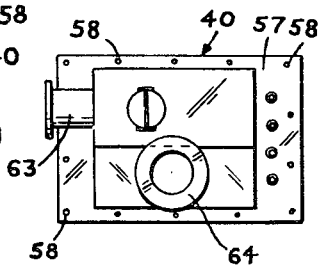
FIG. 5 is a top view of the Vapor Condenser shown in FIG. 2.

Referring to the drawings FIG. 1 shows one form of vapor recovery system in accordance with the present invention which includes generally a cascade compression refrigerant system CR having a high pressure stage refrigeration cycle generally designated 10 and a low pressure stage refrigeration cycle generally designated 20 which acts to cool the coolant in a coolant storage and circulating system CSC in turn operatively associated with a vapor condensing and recovery assembly VCR in which condensation and recovery of low volatile vapors such as hydrocarbon vapors can be effected and passed to a point of storage or other use.

These respective and operatively associated systems will be described.

CASCADE COMPRESSION REFRIGERATION SYSTEM

In the vapor recovery system in accordance with the present invention, recovery of low volatile vapors will be effected by non-contacting heat exchange between the low volatile vapors to be recovered and a coolant in the vapor condensing and recovery system VCR to be more fully described hereinafter.

For efficient recovery of gasoline vapors or chemical vapors consisting of propane, butane, iso-butane, pentane, iso-pentane and other higher molecular weight hydrocarbons to which this invention particularly relates, it is necessary to cool these low volatile hydrocarbon vapors down to a temperature in a range from −70° F to −110° F to effect proper condensation thereof for efficient recovery.

In order to accomplish this a coolant is provided which enters into the proper heat exchange relationship for the reduction of these low volatile vapors to the required condensing temperature range.

In the vapor recovery system shown in FIG. 1 the coolant for the above purpose will be any fluid which does not freeze in the low temperature ranges to which it must be cooled and which will maintain low viscosity at such temperatures to permit the fluid to be pumped through the vapor condensing and recovery assembly VCR to effect the required heat exchange relationship with the low volatile vapors to accomplish condensation thereof.

Such fluids which are particularly adapted for vapor recovery system in accordance with the present invention are methylene chloride and trichloro ethylene which fluids are generally referred to in the trade as "brine".

The brine coolant will be reduced to the operating temperature range between −70° F to −110° F by a cascade compression refrigeration system CR with which it is brought into non-contacting heat exchange relation.

Thus, the high pressure refrigeration cycle 10 of the Cascade Compression Refrigeration System CR will act to circulate a halogenated hydrocarbon which is sold on the open market under the trade designation R502 by means of a compressor 11 which has its suction connected to the evaporator side of a combined condenser-evaporator unit generally designated 12. The compressor 11 discharges the hot compressed gas through line 13 to an air cooled condenser 14 where the gas is cooled and condensed and returned through line 15 through expansion valve 16 which communicates with the combined condenser-evaporator unit 12.

In the high pressure stage refrigeration cycle of the cascade compression refrigeration system the refrigerant will produce a lowering of the temperature in the combined condenser-evaporator unit to −25° F.

In the combined condenser-evaporator unit, the refrigerant R502 from the high pressure stage refrigerant cycle will act to condense a refrigerant such as a halogenated hydrocarbon sold on the open market under the trade designated R503 which it utilized in the low pressure stage refrigeration cycle 20. The refrigerant is delivered to the combined condenser evaporator unit 12 from the compressor 21 of the low pressure stage refrigerant cycle through line 22 to the condensing coil 23 in the combined condenser-evaporator unit 12 and will pass from said condenser evaporator unit through line 24 to the evaporator coil 25 of a brine condenser-evaporator cooling unit 26 from which the compressor 21 takes its suction through line 27 which communicates with the evaporating coil 25.

The low pressure stage refrigerant cycle will maintain the brine condenser-evaporator cooling unit at a temperature of −110° so that brine which is passed through the condensing coil 28 therein from the coolant storage and circulating system CSC hereinafter more fully described will be cooled to at least the required −110° F temperature required to provide the range for condensing the low volatile vapors in the vapor condensing and recovery assembly VCR.

The details of the cascade compression refrigeration system have not been more fully described because the structure and operation of these systems are known and understood by those skilled in the art.

Further while a cascade compression refrigeration system is shown it will be understood that any other suitable technique for cooling the brine coolants down to the operating temperature of −100° F can be utilized without departing from the scope or intent of the present invention.

In the selection of the cascade compression refrigeration system the operating conditions and the refrigerant must be so selected that the condenser can utilize a conventional heat sink such as air for cooling the condenser therein and further the high pressure stage refrigerant will be able to coact with the refrigerant in the low pressure stage refrigeration cycle to bring the refrigerant to an operating temperature which will cool the brine coolant to the required operating temperature for condensing the low volatile vapors in the vapor condensing and recovery assembly VCR as hereinafter described.

BRINE COOLING AND CIRCULATING SYSTEM

Since the vapor recovery system in accordance with the present invention will generally be used on an intermittent basis and must be ready for immediate use at all time it is necessary to provide means for storing and for maintaining the brine coolant at the operating temperature.

In the form of the invention shown at FIG. 1, one system for storing and circulating the brine coolant is shown as including a brine storage reservoir generally designated 30 which is a generally closed cylindrical vessel having a vent means 31 thereon to vent non-condensible gases therein to atmosphere.

The brine storage tank 30 will be filled with the brine at least up to the level of the dotted line shown in the tank 30 to permit the brine to expand or contract as changes in the temperature gradient from the bottom to the top of tank 30 occur.

In order to pass the brine from the brine storage tank 30 to the condenser-evaporator brine cooling unit 26, a first circulating system is provided which includes, a line 32 having a pump 33 therein. Line 32 is connected at one end to the upper section of the storage tank 30 where the warm brine collects and at the end remote therefrom to the evaporator coil 28 in the condenser-evaporator brine cooling unit 26. Brine coolant delivered to the evaporator 25 is returned through a line 34 which extends into the lower-most section of the storage tank 30 for connection with an annular distributor 35 which is provided with a plurality of openings as at 36 for passing the cooled brine into the storage tank 30 at an approximate angle of 45° where it acts to stratify the stored brine so that the coldest brine lies in a substantially quiesent state at the lower-most section of the brine storage tank 30. Stratification or a temperature gradient between the lower-most section and uppermost section will occur in the brine storage tank between the cooled brine coolant which is returned to the bottom of the tank and the heated brine coolant which is returned from the vapor condensing and recovery assembly VCR to the upper end of the tank as is more fully described below.

In order to regulate and maintain the brine coolant in the brine storage tank 30 at the proper temperature, a three way valve 37 is provided on the upstream side of the pump 33 which valve is moved from the normally open position to the normally closed position by actuation from a temperature sensor 38 which acts to move the valve 37 from its normally open position for passing warm brine coolant from the brine coolant storage tank 30 to the evaporator coil 28 of the condenser-evaporator brine cooling unit 26 to a closed position where the brine is circulated through a by-pass line 39 connected between the three way valve 37 and return line 34 when the brine coolant is below a predetermined temperature.

For the vapor recovery unit illustrated in FIG. 1 it was determined that an 8° F span or range would provide a proper operation for the system under all normal load conditions. Thus, whenever the temperature of the brine coolant in the brine storage tank is below −80° F the three way valve 37 will remain in its normally open position. However, as the temperature drops from −80° F to −88° F the sensor 38 will gradually close the three way valve 37 to progressively by-pass more and more of the brine coolant back to the brine storage tank. So long as the brine coolant delivered through the line 32 is −88° F or lower the three way valve 37 will be held in the closed position so as to by-pass all of the brine coolant back through the by-pass line 39 to the lowest section of the brine storage tank 30.

The brine coolant is delivered to the vapor condenser 40 of the vapor condensing and recovery assembly VCR and returned to the brine coolant storage tank 30 by a second circulating system which includes, a pump 41 disposed in a delivery line 42 connected at one end to the lower section of the brine coolant storage tank 30 and at the opposite end to the condensing coil generally designated 43 in the vapor condenser 40 so as to pass the coldest brine in the brine coolant storage tank to this portion of the condensing coil in the vapor condenser 40, for reasons that will appear clear from the description of the vapor condensing and recovery assembly VCR set forth hereinafter. The brine coolant after following a circuitous course through the condensing coil 43 is returned to the brine coolant storage tank 30 through a return line 44 which is connected at one end to the condensing coil and at the end remote therefrom to an annular distributor 45 disposed in the upper end of the brine coolant storage tank 30. Annular distributor 45 is provided with a plurality of openings 46 on the inner annulus to distribute and return the heated brine coolant in a layer at the upper section of the brine coolant storage tank 30 and thus coacts with the annular distributor 35 which returns cold brine coolant at the lower-most section of the brine coolant storage tank 30 to aid in the temperature stratification of the brine coolant. Thus, the coldest brine coolant at −100° F remains at the bottom of the storage tank 30 and the brine gets progressively warmer towards the upper sections of storage tank 30 from which the first circulating system draws the brine to be delivered for heat exchange relation with the cascade compressor refrigerant system CR as has been above described.

Further in the return line 44 a modulating valve 47 is provided which is modulated by a sensor 48 upstream of the modulating valve, the modulating valve 44 acts to control the rate of brine coolant flow through the second circulating system as a function of the load on the condensing coil 43 in vapor condenser 40 in a manner similar to the manner in which the three way valve 37 acts to regulate the rate of flow of the brine coolant from the brine coolant storage tank 30 to the condenser-evaporator brine cooling unit 26 as above described.

Thus in the system shown in FIG. 1 whenever the temperature of the brine coolant is higher than −70° F the modulating valve 47 will be maintained in the open position and as the brine coolant drops below 70° it will be progressively throttled until it will close when the brine coolant reaches −80° F.

The rise and fall of the temperature of the brine coolant will be a function of the load on the vapor condensing and recovery assembly VCR variations of the load on the vapor cooling and recovery assembly VCR acts to vary the temperature condition of the brine coolant in the brine coolant storage tank 30. Variations in the temperature of this brine coolant produces corresponding changes in the three way valve regulating means 37 for maintaining the brine coolant in the proper condition for operative relation with the vapor condensing and recovery assembly VCR now to be described.

VAPOR CONDENSING AND RECOVERY ASSEMBLY

All of the above described structure and operation has been directed to the means for providing a coolant for establishing the required temperature at which the condensing surfaces of the vapor condensing and recovery assembly VCR; and more particularly the condensing coil 43; must be maintained to condense and efficiently recover low volatile vapors at atmospheric pressure, this temperature being in a range from −70° F to −110° F.

However, the condensing mechanism and the recovery mechanism must in addition each be specially constructed and operatively inter-related in order to utilize the brine coolant at these temperatures when operating at atmospheric pressure because such low volatile vapors invariably form only part of a mixture which includes, air and other non-condensible gases, and water vapor all of which are present in the vapor condenser of the vapor condensing and recovery assembly where actual condensation and recovery of the low volatile vapors are occurring in accordance with the present invention.

These air, non-condensible gases and more particularly water vapor components of the mixture present problems to the operation of a vapor recovery unit because at the low temperatures required for efficient recovery the water vapor freezes out of the mixture of gaseous or vapor components at 32° F and will deposit on the condensing surfaces in the form of frost which can in the case of finned tube condensing surfaces plug up the fins and thus act to stop the flow of the vapors and gases through the vapor condenser of the vapor condensing and recovery system. The air and other non-condensible gases must be removed because they present the same problem in the vapor condenser 40 of the present invention, as exists in all other non-contacting heat exchange apparatus and systems, and as will be understood by those skilled in the art must be vented from the vapor condenser to permit continuous condensation to occur when the vapor condensing and recovery assembly are under operation.

The problem is best illustrated with reference to the recovery of low volatile vapors such as hydrocarbon vapors or chemical vapors. In the case of hydrocarbons used in fuels such as gasoline, diesel fuel, jet engine fuels etc. the predominant vapors emitted during the handling of these fuels are butane, iso-butane, pentane, iso-pentane and heavier hydrocarbons with six carbon elements or more therein.

The percentage of hydrocarbon vapors in the mixtures of vapors leaving the apparatus where such fuels are being handled or escaping from the venting points on storage tanks holding such fuels ranges up to 65% of the mixture depending upon the ambient temperature, type of fuel, reed vapor pressure of the fuel, type of tank loading, such as splash or bottom loading, and the extent of the agitation occurring in a given tank. The remaining 35% or more of the mixture depending on the percentages of hydrocarbon vapors present consists of other components such as air, non-condensible gases and water vapor.

It can be readily understood by those skilled in the art that this last mentioned 35% of the components of the mixture more particularly the water vapor must also be handled if the vapor recovery system is to work properly.

The vapor condenser 40 of the vapor condensing and recovery system VCR is particularly designed to meet both the problem of preventing excessive frost build-up on the finned tube condensing surfaces therein and also the common problem of all non-contacting heat exchangers, namely the requirement to provide means for venting air and other non-condensible gases from the vapor condenser.

Thus referring to FIGS. 2–11 of the drawings the vapor condenser 40 is shown as having an elongated hollow outer housing 51 closed at its bottom end and open at its top end and dimensioned so that an inner housing 52 can be mounted in space relation therein by means of a radially inward extending flange 53 at the upper end of each of said housings.

The inner housing is also an elongated hollow member closed at its lower end and open at its top end and defines in the vapor condenser 40 an inner chamber generally designated 54 in turn dimensioned to receive in the upper section thereof a condensing assembly 43 as hereinafter more fully described so that the lower section as at 55 will act as a transfer passage and as a collecting chamber for condensate which is condensed in the condensing assembly 43.

The inner housing will be spaced from the outer housing a pre-determined distance so that this space can be filled with sufficient insulating material 56 to prevent heat loss from the vapor condenser and any suitable type of insulating material can be utilized for this purpose.

Vapor condenser 40 receives a closure means 57 which is connected to the radially inward extending flange 53 as by threaded members 58.

Figure 6:
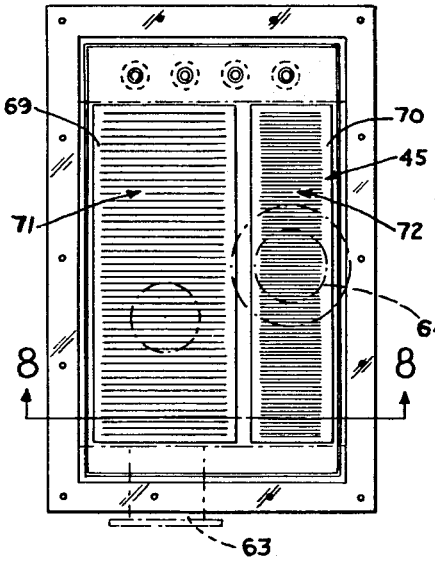
FIG. 6 is a top view of the Vapor Condenser shown in FIG. 5 with the Support Cover and Vapor Plenum Chamber removed taken on line 6—6 of FIG. 2.
Figure 7:
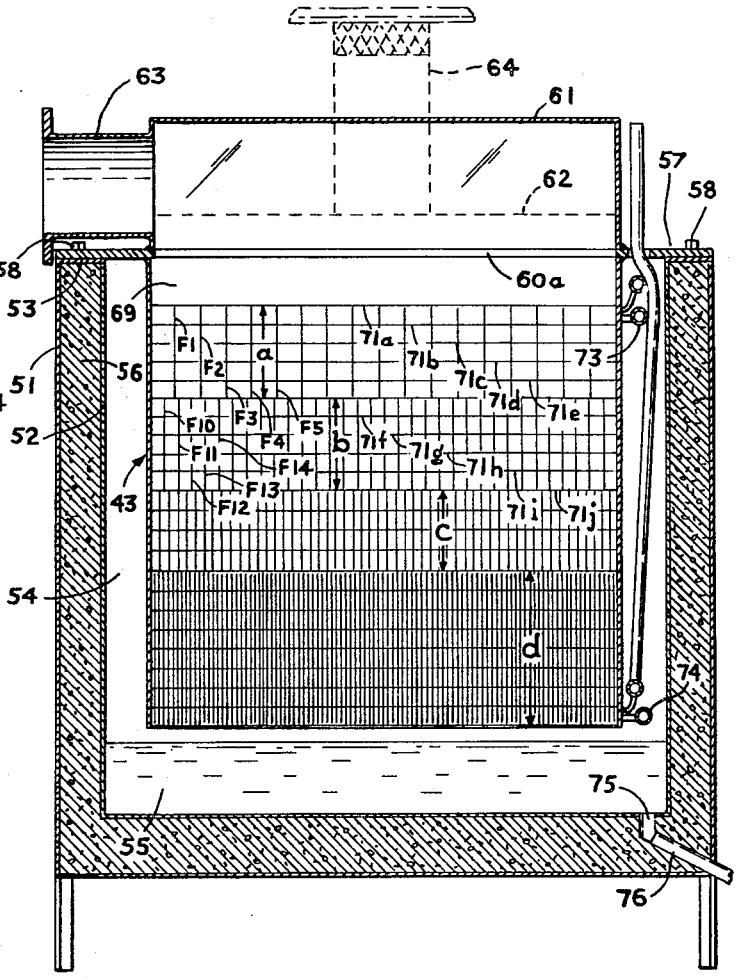
FIG. 7 is a vertical section taken on line 7—7 of FIG. 2.
Figure 12:
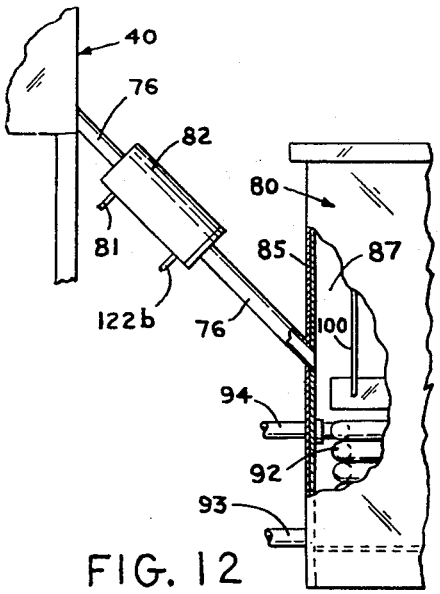
FIG. 12 is a fragmentary sketch showing the connecting conduit between the Vapor Condenser shown in FIGS. 2 - 11 of the drawings and a portion of the decanter operatively associated therewith having a fragment and vertical section for a Vapor Condensing and Recovery Assembly of the type shown in the Vapor Recovery System of FIG. 1.
Figure 8:
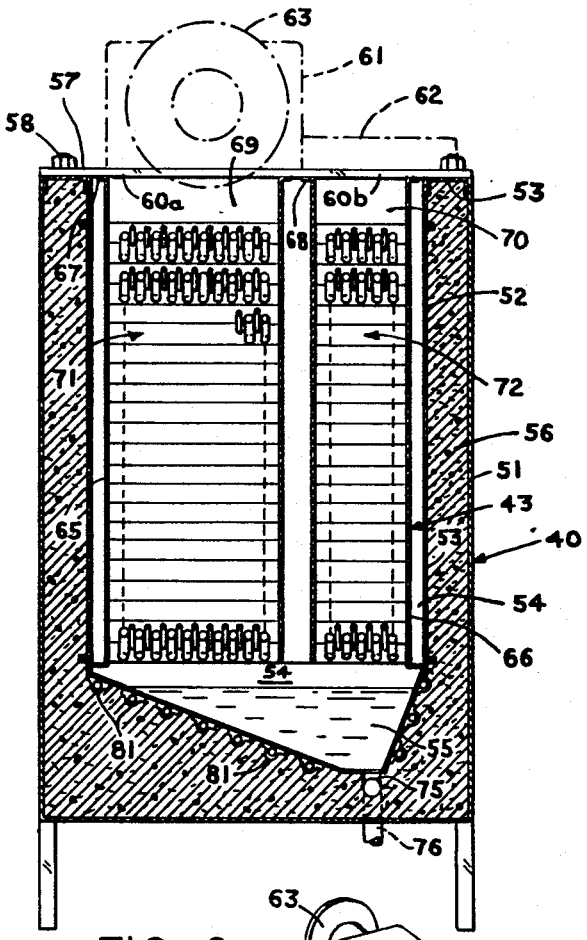
FIG. 8 is a vertical section taken on line 8—8 of FIG. 6.
Figure 10:
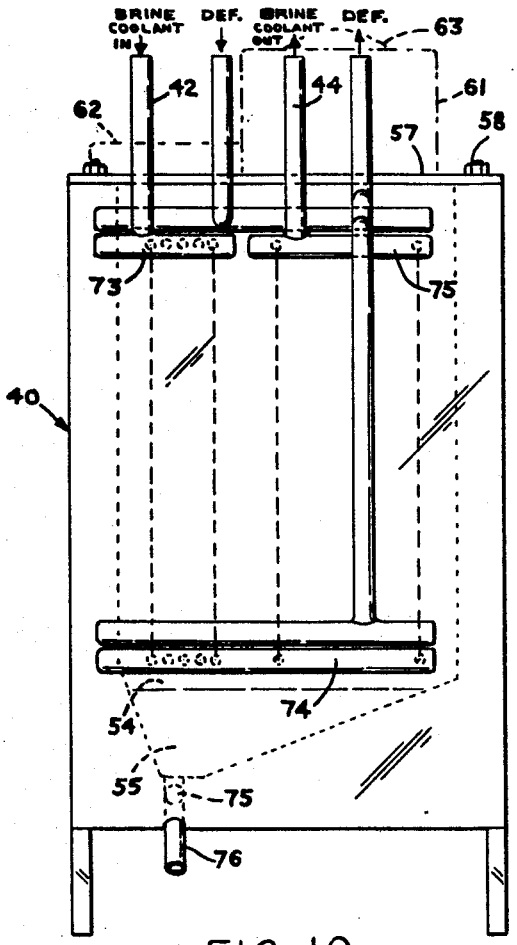
FIG. 10 is a diagramatic side elevation showing the inlet header, crossover header and outlet header for the condensing coil and the inlet header and outlet header for the defrosting coil in the Vapor Condenser shown in FIGS. 1 - 8 of the drawings.

FIGS. 2, 3, 4, 5, 6, 7, 8, and 11 show that the cover number 57 has transfer openings **60*a* and 60*b* therethrough and that on the outer or top face thereof has an inlet plenum 61 and an outlet plenum 62 connected thereto as by welding or any other suitable means about said transfer openings 60*a* and 60*b* respectively as is show in FIG. 8**.

A flanged inlet means 63 forms an inlet passage in communication with the inlet plenum 61 and provides means to connect the vapor recovery system in accordance with the present invention to the source of the vapor mixture having the low volatile vapors which are to be condensed and recovered.

A discharge outlet means forms a vent stack 64 in communication with the outlet plenum 62 for air and non-condensable gases, and the uncondensed portions of the vapor mixture which are passed to the inlet means 63 for the vapor recovery system.

On the lower or under side of the closure member 56 the condenser assembly 43 is connected about the transfer openings **60*a* and 60*b* therethrough as is shown in FIGS. 6, 7, 8, and 11** of the drawings.

In effect the condenser assembly 43 is so connected that it is fixed at the connected end and free at the end remote therefrom. Thus, in assembled position the condenser assembly hangs freely into the inner chamber 54 and can expand and contract with variations in temperature conditions that may occur during the use or operation of the vapor recovery system.

This condenser assembly 43 includes two spaced elongated relatively thin walled cylindrical members generally designated 65 and 66 each respectively provided with a connecting flange means as a 67 and 68 for welding or connecting the condenser assembly 43 into assembled position on the closure member 56.

The cylindrical members 65 and 66 form respectively an entrance flow passage 69 and an exit flow passage 70. Entrance flow passage 69 communicates at its upper end with the opening **60*a* in the closure member 57 and the inlet plenum 61 on the side of the closure member opposite from the entrance flow passage. The lower end of the entrance flow passage communicates with the lower section 54 of the inner chamber 53 of the inner housing 52. Similarly exit flow passage 70 has its lower end in communication with the lower section 54 of the inner chamber 53 and at its upper end communicates through the transfer opening 60*b* in the closure member 57 with the outlet plenum 62**.

Entrance flow passage 69, lower section 54 of the inner chamber 53, and exit passage 70 thus form a U-shaped flow passage in the condenser assembly 43 for the gaseous or vapor mixture having the lower volatile vapors to be condensed which enters and passes through the inlet passage 63 and inlet plenum 61 to the entrance flow passage 69 of the condenser assembly 43.

This U-shaped flow passage is important in the vapor condenser 40 because vapor recovery systems in accordance with the present invention are used on an intermittent basis and therefore must always be ready for immediate use. Therefore, during the off-cycle or during periods of light use even though the brine is kept circulating stray convection currents i.e. currents of ambient air with moisture therein which flow backwards through the vent stack and the outlet plenum must be kept to a minimum. This is accomplished because the U-shaped flow passages act as a thermal trap by reason of the condensate in the lower section 54 of the inner chamber 53.

Condensing is effected in the entrance flow passage 69 and exit flow passage 70 of the convoluted condensing assembly 43 through which brine coolant is passed to cool the condensing surfaces of the condensing assembly 43 to the desired operating range between 70° F and −1 0° F.

Condensing assembly 43, further has an entrance coil section 71 in the entrance flow passage 69 and an exit coil section 72 in the exit flow passage 70.

Brine coolant from the delivery line 42 of the brine cooling circulating means of the Cooling, Storage and Circulating System is connected to a brine coolant inlet header 73 to which the upper end of the exit coil section 72 is connected and thus brine coolant reaches the condensing assembly 43 by first passing through the exit coil section 72 as is shown in FIGS. 1, 6, 8, and 11 which lies in the exit flow passage of the condenser assembly 43. The brine coolant will pass downwardly through the exit coil section 72 to a cross-over header 74 which is connected on one side to the lower end of the exit coil section 72 and on the other side to the lower end of the entrance coil section 71.

From the lower end of the entrance coil section 71 the brine coolant flows upwardly therethrough to a brine coolant outlet header 75 which is connected to the return line 44 for returning the heated brine coolant back to the coolant, storage, and circulating system CSR as above described.

In order to effect efficient condensation of the low volatile vapors in the vapor condenser 43 it is essential and necessary to provide as large a condensing surface as possible that can be maintained at the operating temperatures required for more effective condensation.

In the vapor condenser for the vapor recovery system in accordance with the present invention this is accomplished by utilizing finned type condensing tubes in the coils in the condenser assembly 43. However this presents a problem more particularly in the entrance flow passage because at the operating temperatures for the vapor condenser water vapor freezes and frost builds up on the fins of the finned condenser tubes to the extent that plugging of the entrance flow passage 69 can easily occur unless provision is made to overcome this problem.

In the present invention this is accomplished by spacing the fins on the rows of finned condensor tubes in a pattern so that ample room is provided between the fins to allow for the build-up of frost from the water vapor present in the mixture without blocking off the flow of the non-condensed portion of the mixture through the entrance flow passage 69 and/or the exit flow passage 70.

To illustrate how this is accomplished more particularly in the entrance flow passage 69 reference is had to FIGS. 6, 7, and 8 of the drawings and more particularly FIG. 7 which shows that for the finned condenser tubes closest to the inlet plenum 61 in communication with the entrance flow passage 69 the first five rows of finned condenser tubes 71*a*, 71*b*, 71*c*, 71*d*, and 71 *e* designated a will be provided with fins generally designated F1, F2, F3, F4 and F5, etc. thereon that are widely spaced which in a typical application will be in the order of 1 inch to 2 inches apart and the fins F10, F11, F12, F13 and F14, etc. in the next succeeding rows of coils 71*f*, 71*g*, 71*h*, 71*i* and 71*j* and designated *b* will be less widely spaced apart. Similarly, those in the next sections generally at five row intervals will be progressively less widely spaced.

Thus by reference to FIG. 7, a typical example of this arrangement would be to have the first five rows in the section marked *a* with fins spaced at 1½ inches apart, the next five rows in section *b* with fins spaced ¾ of an inch apart, the next five rows in section *c* with the fins spaced ½ inch apart and finally the last rows of five or more in section *d* with the fins spaced ⅜ of an inch apart.

It is thought clear to those skilled in the art that after about one-third of the way down the entrance flow passage 69 that the water vapor present will all be condensed at the operating temperatures for the vapor condenser 43 and that further problems on the entrance coil section 71 and exit coil section 72 due to frost or ice build-up will not be present.

In regard to the spacing of the fins you will note in FIGS. 6 and 7 that the fins are so positioned that they line up with the fins in the next succeeding section. This is important for two reasons. First, it prevents frost or ice build-up from blocking off the flow of the gaseous or vapor mixture across the entrance coil section 71 in the entrance flow passage. And second, it prevents the pressure drop across the entrance coil section 71 from becoming excessive.

If the pressure drop across the entrance coil section 71 or exit coil section 72 becomes excessively high, back pressure will develop and the relief valve will open on the storage tank or on the tank trucks being filled, from which the gaseous or chemical vapor mixture arises, and the recoverable vapors will be lost to the atmosphere.

If the pressure drop across the entrance coil section 71 or exit coil section 72 becomes excessive it is necessary to place the Defrosting System generally designated DF which is operatively associated with the vapor condenser 40 into operation as is more fully described hereinafter. However, in the present invention this spacing and alignment of the fins in the manner above described will so reduce pressure build-up across the entrance coil section 71 and the exit coil section 72 that the Defrosting System for the Vapor Recovery System in accordance with the present invention will only be required to operate approximately once during each 24 hours of operation and this further acts to minimize the down time for the entire system.

This is particularly desirable because defrosting can be timed to occur at a given Vapor Recovery System installation during periods in which there is a minimum requirement for the use of the facility. Thus defrosting could normally be programmed to occur during the early morning hours when the Vapor Recovery System would usually not be in operation.

Figure 11:
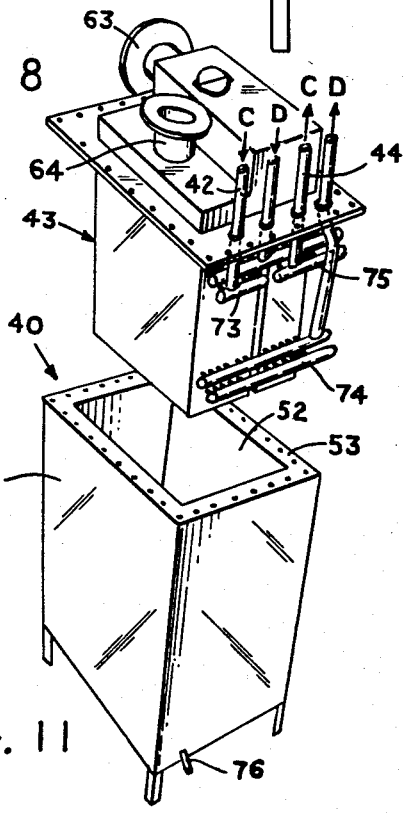
FIG. 11 is an exploded view of the support plate with the inlet and outlet plenums connected to the upper surface thereof and the condensing assembly connected to the lower surface thereof and showing the various headers illustrated in FIG. 10 with their communicating piping for the Vapor Condenser shown in FIGS. 2 - 10 of the drawings.
Figure 9:
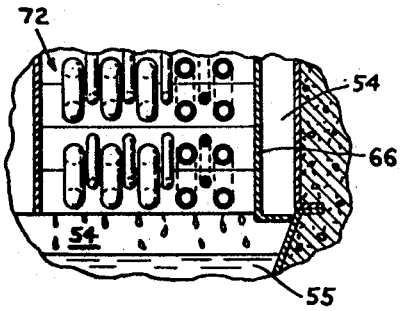
FIG. 9 is a fragmentary side view showing the manner in which the condensing tubes pass through the finned sections associated therewith.
Figure 13:
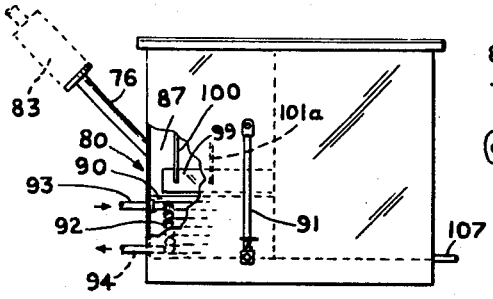
FIG. 13 is a side elevation of the form of decanter shown in the Vapor Condensing and Recovery Assembly for the Vapor Recovery System shown in FIG. 1 with the same fragments and vertical section as is shown in FIG. 12 of the drawings.
Figure 14:
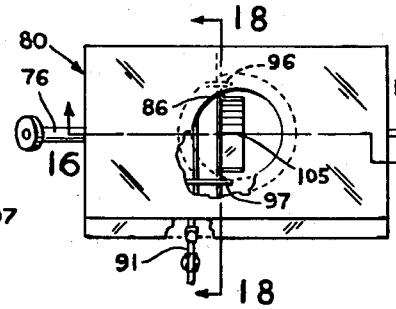
FIG. 14 is a top view of the decanter shown in FIG. 13.
Figure 15:
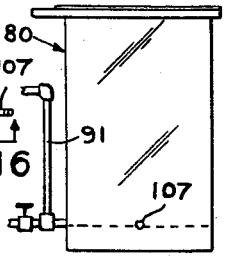
FIG. 15 is an end view from the end of the decanter remote from the end of the decanter connected to the connecting conduit from the Vapor Condenser.

The spacing of the fins on the rows of finned condensor tubes in the exit coil section of the condensor assembly 43 will be approximately the same as in the last section *d* of the entrance coil section 71 and further the cross sectional area of the exit flow passage 70 and the exit coil section 72 can be relatively smaller than that of the entrance flow passage 69 and the entrance coil section 71 respectively as is shown in FIGS. 6, 8, and 11 of the drawings.

The reason for this is that the water vapor in the mixture delivered into the entrance flow passage will logically be removed from the gaseous or chemical vapor mixture by the time it has passed approximately one third of the way through the entrance flow passage 69.

Further from that point on the low volatile vapors are condensed on the cold finned condenser surfaces tubes of the vapor condenser and the condensate will drop into the lower section 55 of the inner chamber 53 where they are collected. The uncondensed vapors, air and other non-condensable gases then reverse their flow direction and pass upwardly through the exit flow passage 70 where further condensation occurs and the effluent vapor consisting largely of the air and non-condensable gases pass to the outlet plenum 62 and are vented through the venting stack 64 connected thereto.

Such removal of water vapor and cooling of the gaseous or chemical vapor mixture to temperatures well below 0° F causes a reduction in the volume of the vapor mixture passing through the flow passages in the vapor condenser 40 and the cross-sectional area of the exit flow passage 70 therefore can be smaller than that of the entrance flow passage 69 as indicated by the figures in the drawings.

However, caution must be taken with respect to the spacing of the fins on the finned condenser tube in an opposite sense for finned spacing that is too close will cause the condensed liquid to hang up between the fins and fail to drop into the collection section 55 of the vapor condenser 40. This can also cause back pressure in the entrance flow passage 69 and exit flow passage 70 to the free flow of the gaseous or chemical vapor mixture through in the vapor condenser 40. The illustrated embodiment at FIG. 7 is thought to illustrate the type of condenser tube finned ratios which prevent this from happening.

The condensate of low volatile vapors collected at the lower section 55 of the inner chamber 53 in the vapor condenser 40 and as shown in FIGS. 1 and 8 this section is sloped or contoured so that the condensate can pass to an outlet port 75 at the lower most point of the inner chamber 53.

A transfer conduit 76 connected at one end to the outlet port 75 and to a decanter 80 at the opposite end will act to transfer the condensate from the vapor condenser and in the decanter now to be described the condensed vapors to be recovered will be separated from other portions of the condensate recovered and by suitable means either returned to the storage tank or to some other point of use.

It will be noted that the lower section of the inner chamber 53 as shown in FIG. 8 and the transfer conduit 76 are provided with heat exchange means respectively at 81 and 82 through which warm brine is circulated, as is hereinafter described, to raise the temperature of the condensate from the excessively low condensing temperatures at which the vapor condenser 40 must be operated in order to effect efficient condensation of the low volatile vapors.

This is desirable because if the condensate temperature can be increased it will eliminate the need to use expensive special steel for insulation on the piping carrying the recovered condensate back to the storage tanks or to the points where the recovered low volatile vapors will be used.

The separation and further heating of the condensed low volatile vapors is accomplished in the decanter by relying on the fact that the condensed low volatile vapors such as the hydrocarbons recovered in the vapor recovery system in accordance with the present invention have a density in the liquid state of approximately 0.56 to 0.60. This density is far lighter than water which has a density of 1. Further condensed hydrocarbons are not miscible with water and therefore can readily separated therefrom and at the respective densities will float on top of any water that is present.

Thus referring to FIGS. 13 to 19 one form of decanter is illustrated having a box-like housing 85 having a central partition 86 therein which divides the space formed by said housing into a separating chamber 87 and a collecting or reservoir section 88.

Figure 16:
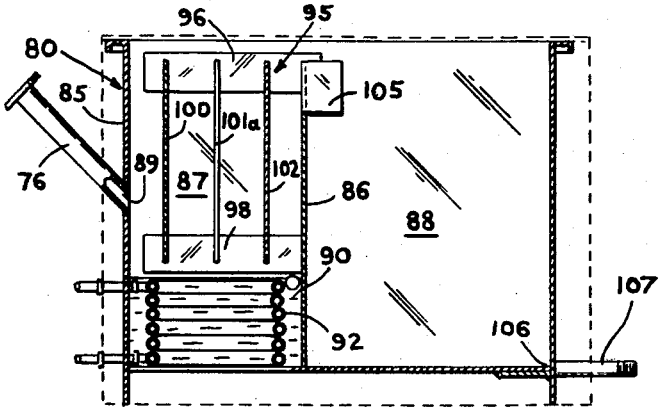
FIG. 16 is a vertical section taken on line 16—16 of FIG. 14.
Figure 18:
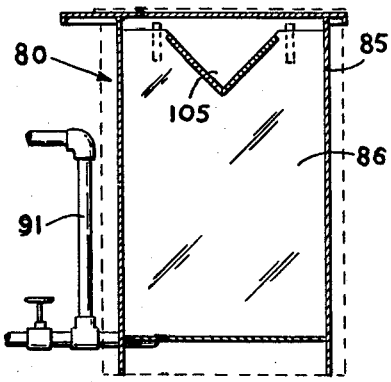
FIG. 18 is a vertical section taken on line 18—18 of FIG. 14.
Figure 19:
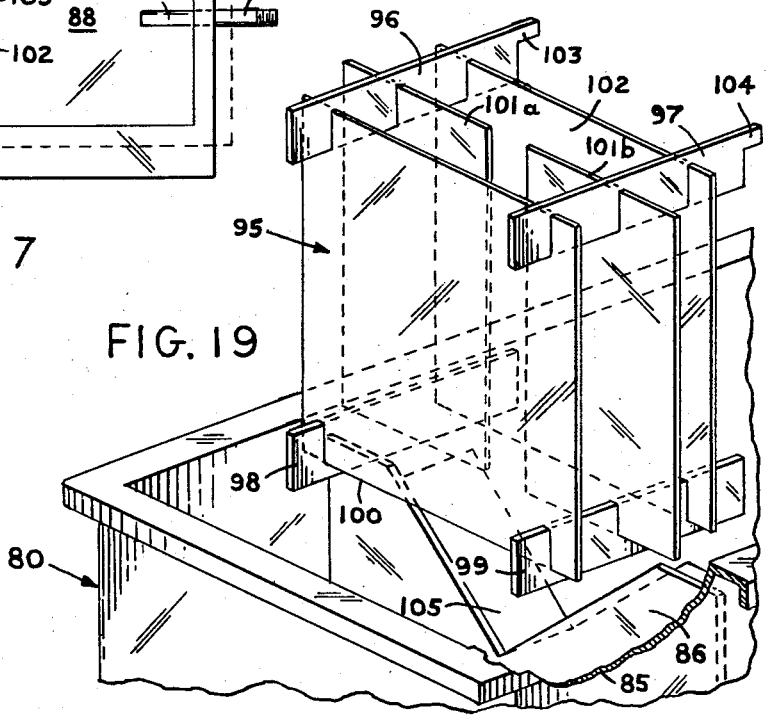
FIG. 19 is a fragmentary exploded view showing the baffle system for creating flow passages in the separating section of the decanter unit shown in FIGS. 13-18 of the drawings.
Figure 20:
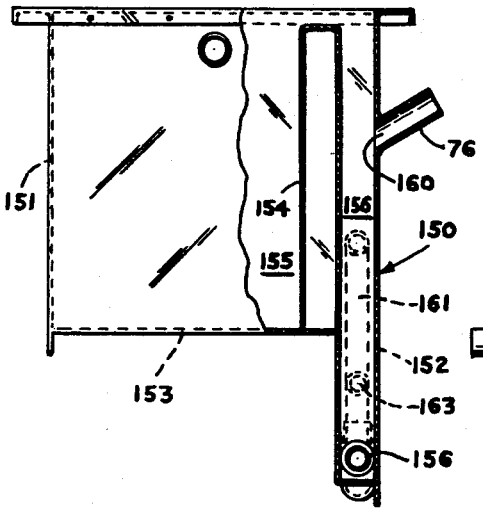
FIG. 20 is a side view partly in vertical section of an alternate form of decanter for use in a vapor recovery system in accordance with the present invention.

Transfer conduit 76 for delivering the collected condensate mixture from the vapor condenser 40 to the decanter 80 is connected to an inlet port 89 medially spaced along the side wall of the separating chamber 87 of the decanter and generally above a point approximately $\frac{1}{3}$ the distance from the bottom of the separation chamber 87 as is shown in FIGS. 16 and 19 of the drawings.

This position is selected because the lower $\frac{1}{3}$ of the separating chamber 87 will at all times be filled or occupied by a liquid such as water generally designated 90 which may be placed there initially for start up purposes but generally can be maintained from either carry over water in the condensate mixture but generally from the water obtained during the defrosting cycle of the vapor condenser hereinafter more fully described.

An overflow and draw off means 91 is provided for adjusting the level of the liquid or water in the separating chamber 87 and a heating coil 92 acts to maintain the liquid or water in the separating chamber 87 at a temperature in range between 35° F and 80° F so that special steel or insulation will not be required for the piping carrying the recovered condensate of the low volatile vapors back to the storage tank or point of use.

Heat exchange means 92 has an inlet pipe 93 and an outlet pipe 94 which are connected to the defrosting circulating system so as to provide the necessary heating fluid to heat and maintain the liquid or water present in the separating chamber 87 of the decanter 80 at the proper temperature.

When the condensate is delivered to the separating chamber 87 of the decanter 80 it enters the section on the side remote from the partition and in order to separate out the non-miscible portions of the mixture and to permit the desired fraction of the mixture to float above such non-miscible portion such as water, a baffle means generally designated 95 is mounted in the upper two-thirds section of the decanter.

The baffle member 95 consists of spaced upper support members 96 and 97 and spaced lower support members 98 and 99 between which are mounted cross plates or partitions 100, 101*a*, 108*a*, 101*b* and 102 as is shown in FIGS. 16, 17, 18, and 19 of the drawings.

The upper support members 96 and 97 are longer than the lower support members 98 and 99 and are formed as at 103 and 104 so that the baffle member 95 can be hooked or hung on the upper edge of the central partition in the decanter. The lower members 98 and 99 will in assembled position abut the side of the partition 86 forming the separating chamber 87 in the decanter. When thus assembled, the spaced plates 100, 101*a*, 101*b* and 102 of the baffle member 95 will be substantially in the longitudinal line of the separating chamber 87 and between the point of entry to the inlet port 89 of the condensate mixture and a weir means 105 formed at the upper end of the partition 86.

The weir means 105 may have a V or other shape and serves as a guide or conduit for transferring the separated condensate of the low volatile vapors from the separating chamber 87 to the reservoir or collecting chamber 88 of the decanter as is shown in FIGS. 14, 16, 17, 18, and 19 of the drawings.

Figure 17:
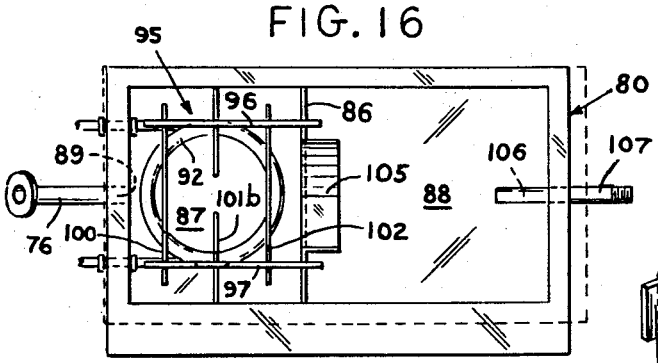
FIG. 17 is a top plan view of the decanter as shown in FIGS. 13-16 with the top removed.

FIGS. 16 and 17 show that the reservoir or collecting chamber 88 has an outlet means 106 at the lowest point therein to which an outlet pipe 107 is connected for passing the recovered condensate back to the storage tank or truck tank or other point of use to which the condensate will be put.

Since the condensate is separated from other contaminants and non-miscible liquids and is at ambient temperature the outlet pipe does not have to have any special form nor does it need to be insulated for flowing or passing this recovered condensate of the low volatile vapors to storage or use.

In the vapor recovery system above described it will be understood by those skilled in the art that the volumetric balance for producing the desired results depends on the designed capacity of the vapor condenser.

The Vapor Condenser entrance passage 69 and exit passage 70 with their respective entrance coil sections 71 and exit coil sections 72 can be made in modules for various volumetric ranges depending on the volumetric quantities of the vapor mixtures that must be handled by the vapor condenser at a given installation.

The respective brine coolant and circulating system and cascade compression refrigerant system will be sized and balanced to meet the given volumetric range of a particular vapor recovery system to provide the operation above described.

Similarly the Defrosting System DF will also be sized depending on this volumetric range and such defrosting system DF will now be described.

DEFROSTING SYSTEM

The construction of the finned spacing more particularly on the entrance coil section 71 in the entrance flow passage 69 to prevent frost build-up from blocking off the flow of gaseous or chemical vapors through the respective entrance coil section 71 and exit coil section 72 has been above described.

The object of this construction is to prevent frequent defrosting cycles because such defrosting cycles necessitate shutting down operation of the vapor recovery unit.

It is, however, important that the pressure drop across the entrance coil section 71 and/or the exit coil section 72 not be excessive under any circumstances because if the pressure drop builds up excessively it will produce back pressure in the tank or other system passing the vapor mixture to the vapor recovery unit. This will cause the relief valves on the storage tanks or the tanks being filled or the system from which the vapors are being removed to open and permit such vapors to be expelled without being recovered.

It is desirable therefore to control the degree of frost or ice build-up on the fins and to that end a defrosting system is provided for defrosting the entrance coil section 71 and the exit coil section 72 of the condenser assembly 43. Defrosting of the condensor assembly 43 on the vapor condenser 40 can be timed or programmed to occur when there is a minimum of activity or use of the vapor recovery system such as during the early morning hours when such systems are not usually in operation.

The removal of the frost or ice collected on the fins in the entrance coil section 71 and the exit coil section 72 is also desirable because it has been determined that during formation of the frost or ice on the fins, the frost will trap or collect condensed low volatile vapors therein indicating, the possibility for example, in the recovery of hydrocarbons, that a hydrate of the hydrocarbons has been formed as the frost is deposited on the fins. Therefore, during the defrosting cycle, the mixture obtained from the melted frost and removed from the vapor condenser will in addition to water also contain recovered condensate of the low volatile vapors such as the valuable hydrocarbons to which this vapor recovery system is particularly adapted.

Accordingly, referring to FIG. 1, the Defrosting System DS is shown as having an insulated reservoir or storage tank 110 for hold a suitable defrosting fluid which may also be a brine such as methylene chloride identical with the type of brine used as the coolant in the Cooling, Storage and Circulation System CSC above described or it may be any other suitable type of brine such as trichloro ethylene or other liquid which is function for the heat exchange relationships required for maintaining the defrosting fluid at the desired temperature and for accomplishing the transfer of heat to the condenser assembly 43 to effect the defrosting of the coil 71 and 72 therein.

Since the defrosting system also serves the collateral function of providing a heat exchange medium for raising the condensate mixture in the vapor condenser 40 and the separator chamber 87 of the decanter 80 to approximately ambient temperature as hereinbefore described, the defrosting fluid must also be capable of this additional function.

Similar to the manner in which the brine coolant is maintained within a predetermined temperature range, the defrosting fluid must be maintained at a temperature in a range between 70° F and 90° F.

The temperature of the defrosting fluid will vary during the defrosting procedure and during the use of the defrosting fluid for raising the temperature of the collected condensate of low volatile vapors during the transfer, separation and recovery procedure as above described.

The means for circulating the defrosting fluid so as to maintain the predetermined temperature thereof and also the means for circulating the defrosting fluid either for defrosting procedures and/or through the portions of the vapor condensing and recovery assembly for raising the temperature of the collected condensate will now be described.

Thus, referring to FIG. 1, of the drawings the temperature of the defrosting fluid is maintained by a first circulating system which connects the reservoir or storage tank 110 to the side of the cascade compression refrigeration system CR which carries the hot compressed gases from the high pressure stage compressor 11 to the air cooled evaporator 14.

FIG. 1 shows a delivery conduit 111 connected at one end to the upper section of the defrost fluid reservoir or storage tank 110 and at the end remote therefrom to a heat exchanger 112 which is disposed in the line between the high pressure stage compressor 11 and the air cooled evaporator 14 through which the hot compressed gases will pass.

The defrost fluid from the reservoir or storage tank 110 is delivered by delivery conduit 111 to the heat exchanger 112 where the defrost fluid is passed in non-contacting heat exchange relationship with a heating coil 114 connected in the conduit 13.

The defrost fluid thus will be heated in the heat exchanger 112 and will be returned to the reservoir or storage tank 110 through return line 115 which is connected at one end to the heat exchanger 112 and to the end remote therefrom to a common return line 126 to the reservoir or storage tank 110.

Any suitable type of valve means such as a solenoid operated valve 116 which is activated by a temperature sensor 117 can be utilized to control delivery of fluid from the reservoir or storage tank 110 to the delivery line 111.

Thus, in operation when the temperature of the defrost fluid at the upper end of the reservoir or storage tank 110 drops below 80° F the sensor 117 will open the solenoid operated valve 116 and a common pump 120 for the defrosting system DS will act to deliver the defrost fluid from the reservoir or storage tank 110 to the heat exchanger 112 and return the same through the return line 115 to the storage tank 110.

Use of the defrosting fluid is accomplished through other circulating means which connects the reservoir or storage tank 110 to the various elements of the vapor condensing and recovery system VCR and thus defrost fluid from the reservoir or storage tank 110 is drawn through a main delivery line 121 connected at one end to the reservoir or storage tank 110 and at the opposite end to the common pump 120. The main delivery line will pass the defrost fluid either alternatively or simultaneously not only through the circuit above described but through additional circuits.

The first such additional circuit includes, a vapor condenser delivery line **122*a* which connects at one end to the discharge side of the pump 120 and at the end remote therefrom to a main defrost fluid header 123 which feeds the defrost coil 124 having an outlet header 125 in turn connected to one end of the common return line 126. The common return line is connected at the end remote from the discharge header to the reservoir or storage tank 110 and has a uni-directional check valve 127 therein all of which is shown in FIG. 1** of the drawings.

The second such additional circuit includes, a condensate heating delivery line **122*b* connected to the discharge side of pump 120 which delivers hot defrosting fluid to the heat exchange mechanism 82 on the outside of the double pipe transfer conduit 76 for transferring condensate from the vapor condenser 40 to the decanter 80 in the vapor condensing and recovery assembly VCR, and heat exchange means 81 in the lower or collecting section 55 of the vapor condenser 40. From the collecting pan heat exchange means 82 the return defrost fluid connecting conduit 129 connected between the heat exchange means 82 and the common defrost fluid return line 126 will pass the defrost fluid back to the reservoir or storage tank 110**.

The third such additional circuit includes a decanter defrost fluid delivery conduit 130 also connected at one end to the discharge side of the pump 120 and at the end remote therefrom to the inlet pipe 93 for the heating coil 92 in the separating chamber 87 of the decanter 80. A decanter defrost fluid return line 131 connected at one end to the outlet 94 of the heating coil and to the end remote therefrom to the common defrost fluid return line 126 provides means for delivering the hot defrosting fluid to the heating coil 92 for maintaining the condensate at the desired ambient temperature and for returning the defrost fluid back to the reservoir or storage tank 110. A normally closed solenoid operated decanter heating valve 132 will control the flow of hot defrosting fluid to the heat exchanger 92 by means of a temperature operated sensor 133 in communication with the water which surrounds the heat exchanger 92 in the separating chamber 87 of the decanter 80 as has been above described. The sensor 133 will actuate the decanter valve 132 to open when the temperature of the water in the separating section drops below 40° F.

OPERATION

Before the vapor recovery unit in accordance with the present invention is placed into operation it is necessary to start the cascade compression refrigeration system CR in order to bring the operating temperature of the combined condenser-evaporator units 12 and 26 to the required temperature for cooling the brine coolant to the required temperature of −100° F.

When the combined condenser-evaporator units 12 and 26 are at operating temperature the pump 33 is started and the brine coolant is circulated from the brine coolant storage tank through the evaporator 28 and back to the brine coolant storage tank as has been above described to bring the brine coolant into proper heat exchange relationship in the combined condenser-evaporator unit 26 for reducing it to the desired low temperature of −100° F.

While these steps are in operation the pump 120 will be pumping defrosting fluid from the defrosting fluid storage tank 110 through line 111 to the heat exchanger 112 and returning the same through line 115 to the defrosting fluid storage tank 110 so as to bring the defrosting fluid to the desired +90° F operating temperature required for effecting the increase in temperature of the recovered condensate of the low volatile vapors as has been above described.

When these conditions are established at no load on the system the system is ready for operation.

In order to place the vapor recovery unit into operation the pump 41 is started so that brine coolant is continually passing through delivery line 42 through the condenser assembly 43 and back by return line 44 to the brine coolant storage tank 30 as has been above described.

The vapor mixture containing the low volatile vapors to be condensed is then delivered through inlet piping 140 which is connected to the inlet means 63 in communication with the inlet plenum 61 where it passes downwardly through entrance flow passage 69 through lower section 54 and then turns 180° and passes upwardly through exit flow passage 70 which permits the air, non-condensible gases and uncondensed remaining vapor to pass to atmosphere through the vent stack 64.

During the passage of the vapor mixture through the entrance flow passage 69 and exit flow passage 70 water vapor will be deposited on the fins on the condensor assembly 43 in approximately the first third of the entrance coil section 71 thereof and beyond this point the low volatile vapors will be condensed dropping into the lower or collecting section 55 to pass through the port 75 and double pipe 76 to the decanter 80.

If the frost due to freezing of the water vapor builds up on the condenser assembly 43, a sensor will signal the pump 41 to stop and delivery of the vapor mixture through the inlet piping 140 will be terminated. Pump 121 will commence operation, control valve 121*a* opening in the main delivery line on the discharge side of the pump so that the defrosting fluid can pass simultaneously through lines 122*a* and 122*b* to the respective condenser assembly 143, the collecting section 55 and heat exchanger 82 so that the frost will be melted on the entrance coil section 71 and exit coil section 72 collected in the collecting section 55 and passed to the decanter 80 as has been above described.

In the decanter 80 the condensed low volatile vapors will be separated, passed to the recovery section 88 and then through line 107 to be returned to the storage tank, truck tank or other point of use by any suitable means. Thus, there is provided a complete vapor recovery system in which an automatically controlled non-contacting condensing unit operating at atmospheric pressure is utilized.

The unit can be fully factory packaged to particular specifications and the recovered low volatile vapors contain no water and are substantially in pure form and can be pumped to any location through ordinary piping arrangements.

ALTERNATE DECANTER MEANS

Where the condensed low volatile vapors have a high vapor pressure it has been found that they can drive the water from the separating chamber 87 of the decanter 80 through the overflow means 91.

In order to meet this problem it may be desirable to use an alternate decanter construction as is shown in FIGS. 20 – 24 of the drawings.

In FIGS. 20 – 24 the alternate form of decanter generally designated 150 is shown as having a substantially box — like main housing 151 with a downwardly extending section 152 continuous therewith at one end which extends substantially below the bottom 153 of the main housing 151.

The main housing 151 has a relatively wide partition 154 inwardly of the downwardly extending section 152 so that the main housing 151 and the partition 154 define a collecting or recovery chamber 155 in the main housing 151 and a relatively elongated narrow separating chamber 156 continuous with the downwardly extending section 152 on the main housing 151.

Figure 21:
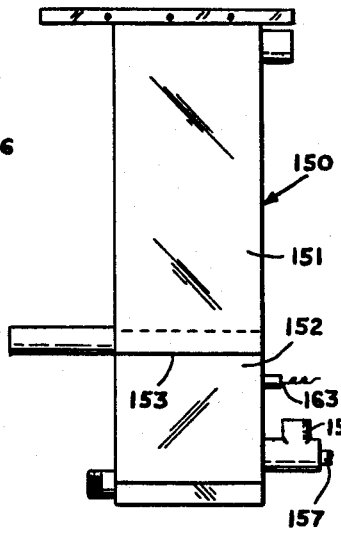
FIG. 21 is a left end view of the alternate form of decanter shown in FIG. 20.
Figure 22:
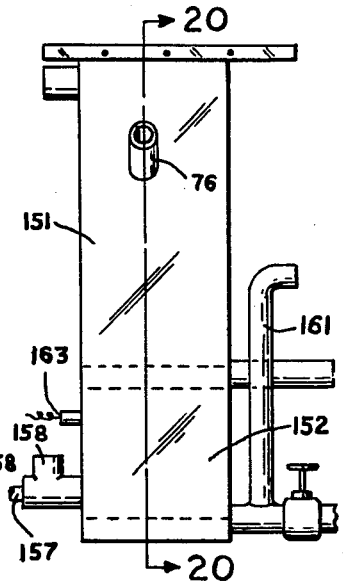
FIG. 22 is a right end view of the alternate form of decanter shown in FIG. 20.
Figure 23:
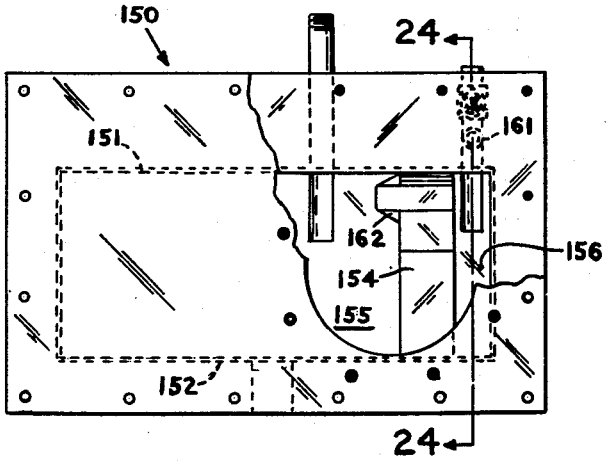
FIG. 23 is a top view of the alternate form of decanter shown in FIG. 20 with a fragment of the cover removed to show the inner chambers therein in plan view.
Figure 24:
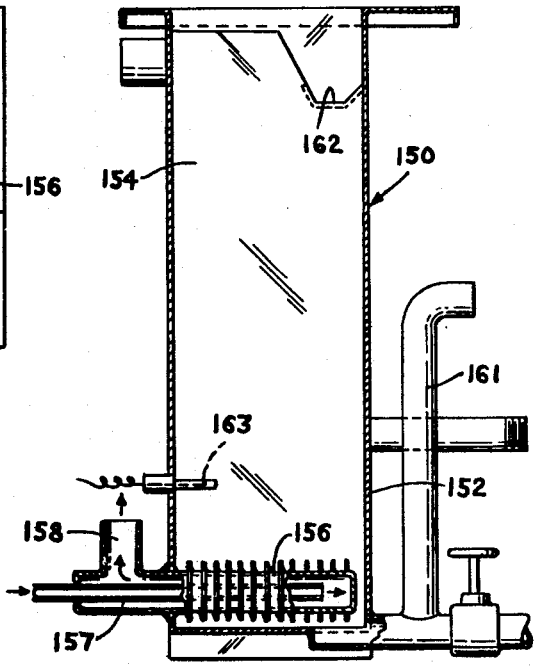
FIG. 24 is a vertical section taken in line 24—24 of FIG. 23.

In the lower third of the separating chamber 155 a heating coil 156 is provided having an inlet 157 and an outlet 158 as is clearly shown in FIGS. 21 – 22 and 24 of the drawings.

Further the outer wall forming the separating chamber 156 will have an inlet port as at 160 medially along the upper section thereof and this inlet port will be connected to the transfer conduit 76 in the same manner that the transfer conduit 76 is connected to the decanter 80 above described, and for the same purpose of delivering the condensate mixture formed in the vapor condensor 40.

The separating chamber 156 will be provided with an overflow and delivery pipe at 161 to control the level of the water in the lower one third section of separating chamber 158. The elongated and narrow nature of the separating chamber will limit the quantities of condensate which can be collected therein. Therefore, even if condensates with high vapor pressure are present they will not be able to displace the water from the lower section of the separating chamber when the system is not in operation.

Similar to the form of the decanter 80 shown at FIG. 1 of the drawing when the decanter 150 is connected to the transfer conduit 76 lines 130 and 131 from the defrost system will be connected to the inlet 157 and outlet 158 and a sensor 163 can be connected so that defrosting fluid from the defrosting system can be delivered to the heating coil 156 in the separating chamber 156 in the same manner as set forth above with respect to the sensor 133 for the decanter 80.

In the partition 154 adjacent to the upper end thereof a weir 162 is formed so that the separated condensate can flow into the recovery chamber 155 when the condensate in the separating chamber 156 reaches the level of the weir.

Further, due to the elongated and narrow nature of the separating chamber it was found that by merely offsetting the weir means 162 that the baffle for slowing the transfer of the condensate from the inlet port 160 to the weir 162 as shown for the form of the decanter 80 could be eliminated.

This alternate form of decanter can be fully substituted for decanter 80 in the form of the invention shown in FIG. 1 without departing from the scope of the vapor recovery system there shown in accordance with the present invention and without changing the operation as above described.

VAPOR RECOVERY SYSTEM WITH SINGLE STORAGE TANK FOR BRINE COOLANT AND DEFROSTING FLUID

In the form of the invention shown in FIG. 1 the brine coolant and defrosting fluid are each constituted in separate storage and circulating systems and are operated independently of each other as the conditions of operation require.

Figure 25:
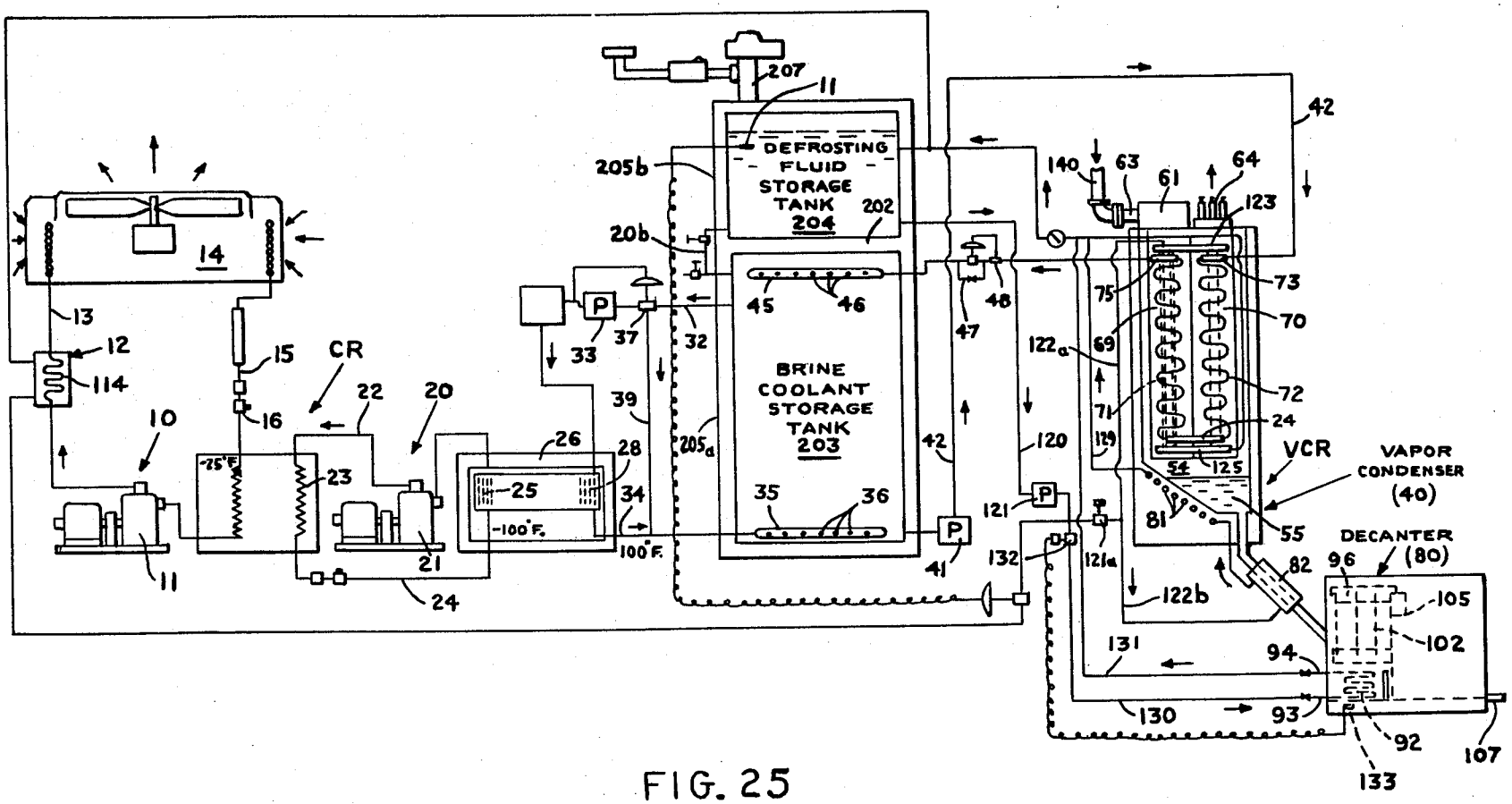
FIG. 25 is a schematic view of another form of vapor recovery system in accordance with the present invention.

In FIG. 25 another simpler and more compact form of the present invention is illustrated in which a single unit tank is provided for both the brine coolant and the defrosting fluid.

The system is otherwise identical to the form of the invention shown in FIG. 1 and like parts therefrom are given the same character numerals and character letters.

Now, referring to FIG. 26 the vapor recovery system as shown includes a cascade compression refrigeration system CR, a single unit storage and circulating system SUSC for brine and defrosting fluid SC, and a vapor condensing and recovery system VCR.

The cascade compression refrigeration system CR in FIG. 25 is identical in structure and operation to that above described for the from of the invention shown in FIG. 1.

The Cascade Compression Refrigeration System CR in the system shown in FIG. 26 is operatively associated with the single unit storage and circulation system SUCR for the same purposes and objects that it is operatively associated with the brine coolant storage and circulation system CSC and the defrosting system DF in the form of vapor recovery unit shown in FIG. 1.

Thus, the single unit storage and circulating system SUSC is shown to include, air insulated elongated cylindrical storage unit generally designated 201 which has a transverse partition as a 202 which divides the storage unit 201 into a brine coolant storage chamber 203 and a defrosting fluid storage chamber 204, the defrosting fluid storage chamber 204 being disposed in the upper one-third section of the storage unit 201 and the brine coolant storage chamber 203 being disposed in the lower two-thirds section of the storage unit 201.

The lower two-thirds section of storage unit 201 will receive heavier insulation as at 205*a* than the insulation 205*b* for the upper one-third section thereof.

Partition 202 will be relatively wide to prevent heat transfer from the warm defrosting fluid at 90° F in the storage chamber 204 to the cold brine coolant −100° F in the storage chamber 203.

In this form of the invention the brine coolant and the defrosting fluid can be the same such as methylene chloride and any suitable type of transfer and balancing device as 206 will be provided to fill the brine coolant chamber 203 and to allow for expansion and contraction of the brine coolant in brine coolant chamber 203.

When the same brine fluid such as methylene chloride is used the storage chamber 204 will be filled only to the level indicated by the dotted line therein and the storage chamber 204 will be vented to atmosphere through the vent stack 207.

By further reference to FIG. 25 all the remaining elements of the system are identical to those above described for the form of the invention shown in FIG. 1 of the drawing.

The operation is similar in that the brine coolant is removed from the brine coolant storage chamber 203 by the pump 33 and after passing through the evaporator is returned at the lower operating temperature to the lower annular distributor ring 35 at the lower-most point in the brine coolant storage chamber 203 where the coolant will stratify with respect to temperature by coacting with the upper annular distributor ring 45 which returns the heated brine coolant after the brine coolant is passed by the second circulating system to the vapor condenser 40 with same manner and by the same elements as above described for the form of the invention shown in FIG. 1.

The recovery operation of the vapor condensation and recovery system in the form of the invention shown in FIG. 25 thus uses the same brine coolant at the same temperature and operates in every respect in the same manner above described for the form of the invention shown in FIG. 1.

Similarly, when defrosting is required the defrosting fluid which is past in heat exchange relation with heat exchanger 112 to bring it to operating temperatures of 90° F will be past by a second circulation system to the vapor condenser 40 by the same elements and in the same manner as above described for the form of the invention shown in FIG. 1.

Since the vapor condensing and recovery system in FIG. 25 is in all ways identical with the same elements as shown in FIG. 1 this system will also operate in the identical manner above described.

The form of the invention shwon in FIG. 25 is also an automatically controlled condensation system operating at atmospheric pressure. It is singularly compact and factory packaged and therefore adopted for small gasoline bulk stations for distributing gasoline and other fuels.

While the foregoing description illustrates various preferred embodiments of apparatus and systems in accordance with the present invention, it will be appreciated that certain changes and modifications may be made in the structure of these disclosed arrangements without departing from the spirit and scope of the invention and that the same is defined by the claims as hereinafter set forth.

What is claimed is:

1. A vapor condensing and recovery assembly for recovering vapors of low volatile liquids such as hydrocarbons, a. vapor condensing means having, a housing, b. said housing having, an inlet means for passing vapors to be condensed to said vapor condensing means, and an outlet means for venting air and non-condensable gases from said vapor condensing means, c. U-shaped flow passage means in the upper section of said housing having, an entrance flow passage, and an exit flow passage, d. condensing means in said U-shaped flow passage means including, means on the condensing means to control the formation of frost and ice thereon, e. said entrance flow passage in communication with the inlet means and said exit flow passage in communication with the outlet means, f. a collecting space in said chamber disposed below the condensing means for collecting condensate from the condensing means.

g. a decanter for separating the condensed vapor from the collected condensate and for recovering the same, and h. means connecting the collecting space in said housing to the decanter for passing collected condensate thereto.

2. In a vapor condensing and recovery assembly as claimed in claim 1 including, a. means operatively connected to said condensing means for defrosting the same, and b. control means for regulating the flow of defrosting fluid to said defrosting means.

3. A decanter for recovering condensed vapors of low volatile liquids, such as hydrocarbons, a. housing means, b. a partition in said housing means defining a separating chamber and a collecting chamber therein, c. an inlet port in said housing in communication with the separating chamber for passing condensate having condensed vapors of low volatile liquids therein to the separating chamber, d. means in the separating chamber for elevating the temperature of the separated condensed vapors, e. weir means on said partition for flowing separated vapors from the separating chamber to the collecting chamber, and f. discharge means in the housing for removing the collected condensed vapors of low volatile liquids from the collecting chamber.

4. In a decanter as claimed in claim 3 including, baffle means in the separating chamber removably connected to the partition to define in the separating chamber an elongated flow path between the inlet port and the weir means for separated condensed vapor sufficient to insulate against the flow of heat from the separating chamber to the collecting chamber.

5. In a Decanter as claimed in claim 3 wherein, a. said housing is provided with a down-leg extending substantially below the lowest level of the collecting chamber, and b. the means for elevating the temperature of the separated condensed vapors is in the down leg of the housing.

6. In a Decanter as claimed in claim 5 wherein said partition means is formed sufficiently wide so as to insulate against heat flow from the separating chamber to the collecting chamber.

7. In a Decanter as claimed in claim 3 including, a. temperature sensing means at a predetermined point medially in said separating chamber, means for delivering defrosting fluid to said means for elevating the temperature of the separated condensed vapors in said separating chamber including, a regulating valve, and c. said regulating valve connected to receive signals from said temperature sensing means to control the amount of defrosting fluid delivered to the means for elevating the temperature of separated condensed vapor in said separating chamber.

* * * * *